US010870209B2

(12) United States Patent
Demko et al.

(10) Patent No.: US 10,870,209 B2
(45) Date of Patent: Dec. 22, 2020

(54) FOLDING KNIFE WITH BLADE LOCK

(71) Applicant: Cold Steel, Inc., Ventura, CA (US)

(72) Inventors: Andrew Demko, Wampum, PA (US); Mike Wallace, New Castle, PA (US)

(73) Assignee: COLD STEEL, INC., Ventura, CA (US)

( * ) Notice: Subject to any disclaimer, the term of this patent is extended or adjusted under 35 U.S.C. 154(b) by 0 days.

(21) Appl. No.: 16/252,508

(22) Filed: Jan. 18, 2019

(65) Prior Publication Data

US 2020/0230830 A1 Jul. 23, 2020

(51) Int. Cl.
*B26B 1/02* (2006.01)
*B26B 1/04* (2006.01)

(52) U.S. Cl.
CPC ..... *B26B 1/042* (2013.01); *B26B 1/048* (2013.01)

(58) Field of Classification Search
CPC ..... B26B 1/042; B26B 1/048; B26B 1/04; B26B 1/044; B26B 1/046
USPC ..... 30/160, 161
See application file for complete search history.

(56) References Cited

U.S. PATENT DOCUMENTS 868,179 A * 10/1907 Griswold ..... B26B 1/046 30/161
1,373,993 A * 4/1921 Boe ..... B26B 1/04 30/161
1,451,607 A * 4/1923 Bates ..... B26B 1/042 30/161
4,563,813 A * 1/1986 Fortenberry ..... B26B 1/042 30/161
6,941,661 B2 * 9/2005 Frazer ..... B26B 1/048 30/160
7,020,969 B2 * 4/2006 Roberson ..... B26B 1/044 30/152
8,296,958 B1 * 10/2012 Frazer ..... B26B 1/042 30/155
9,751,222 B2 * 9/2017 Kao ..... B26B 1/042
2003/0070299 A1 * 4/2003 Frazer ..... B26B 1/048 30/161
2004/0134075 A1 * 7/2004 Chu ..... B26B 1/048 30/161
2005/0223562 A1 * 10/2005 Pardue et al. ..... B26B 1/04 30/161
2009/0144986 A1 * 6/2009 Frazer ..... B26B 1/042 30/159
2016/0052151 A1 * 2/2016 Chu ..... B26B 1/04 30/161

* cited by examiner

*Primary Examiner* — Clark F Dexter
(74) *Attorney, Agent, or Firm* — William F. Lang, IV; Lang Patent Law LLC

(57) ABSTRACT

A folding knife has an elongated blade having a pivot end and an opposed free end, the pivot end of the blade pivotally connected to a handle, the blade being movable between a closed position in which the blade is protectively received by the handle and an open position in which the blade extends away from the handle, a back lock element pivotally connected to the handle and having a block portion, the back lock element movable between a locked position in which the block portion operably contacts a portion of the pivot end of the blade to prevent movement of the blade from the open position to the closed position, and an unlocked position in which movement of the blade from the open position to the closed position is enabled, and a safety element movable between an engaged position and a disengaged position.

10 Claims, 6 Drawing Sheets

FOLDING KNIFE WITH BLADE LOCK

FIELD OF THE INVENTION

The present invention relates to knives, and more particularly to a folding knife that features a rocker lock with a secondary safety that when engaged makes the rocker lock enormously resistant to shock and impact.

BACKGROUND OF THE INVENTION

Back lock knives are a popular style of folding pocket knives. "Back lock" refers to a blade locking mechanism featuring a rocker arm pivotally positioned on the spine of the handle. The rocker arm includes a head portion that is spring-biased to engage a notch on the blade's tang, thereby locking the blade open. The knife's handle has a notch that exposes a rear portion of the rocker arm. To release the back lock, the user presses the exposed portion of the rocker arm downwards, which pivots the rocker arm to disengage the head portion from the notch on the blade's tang, thereby enabling the blade to close. In the closed position, the head portion of the rocker arm engages a separate portion of the blade's tang to releasably secure the blade in the closed position. One disadvantage of back lock folding knives is that the user must use two hands to most easily and safely close a back lock folding knife. This can be inconvenient when the user wants to close the knife while simultaneously holding onto the object being cut. A serious disadvantage of back lock folding knives is that inadvertent depression of the rocker arm, or extreme force exerted upon the blade, can cause the head portion of the rocker arm to be dislodged from the notch on the blade's tang, enabling the blade to close unintentionally. Inadvertent closure of the blade could lead to serious injury to the user.

Therefore, a need exists for a new and improved folding knife that features a rocker lock with a secondary safety that when engaged makes the rocker lock enormously resistant to shock and impact. In this regard, the various embodiments of the present invention substantially fulfill at least some of these needs. In this respect, the folding knife according to the present invention substantially departs from the conventional concepts and designs of the prior art, and in doing so provides an apparatus primarily developed for the purpose of featuring a rocker lock with a secondary safety that when engaged makes the rocker lock enormously resistant to shock and impact.

SUMMARY OF THE INVENTION

The present invention provides an improved folding knife, and overcomes the above-mentioned disadvantages and drawbacks of the prior art. As such, the general purpose of the present invention, which will be described subsequently in greater detail, is to provide an improved folding knife that has all the advantages of the prior art mentioned above.

To attain this, the preferred embodiment of the present invention essentially comprises an elongated blade having a pivot end and an opposed free end, the pivot end of the blade pivotally connected to a handle, the blade being movable between a closed position in which the blade is protectively received by the handle and an open position in which the blade extends away from the handle, a back lock element pivotally connected to the handle and having a block portion, the back lock element movable between a locked position in which the block portion operably contacts a portion of the pivot end of the blade to prevent movement of the blade from the open position to the closed position, and an unlocked position in which movement of the blade from the open position to the closed position is enabled, a safety element movable between an engaged position and a disengaged position; when the blade is in the open position the safety element being configured when in the engaged position to contact the back lock element and to prevent the back lock element from moving to the unlocked position, and when the safety element is in the disengaged position to enable movement of the back lock element to the unlocked position to enable movement of the blade to the closed position. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
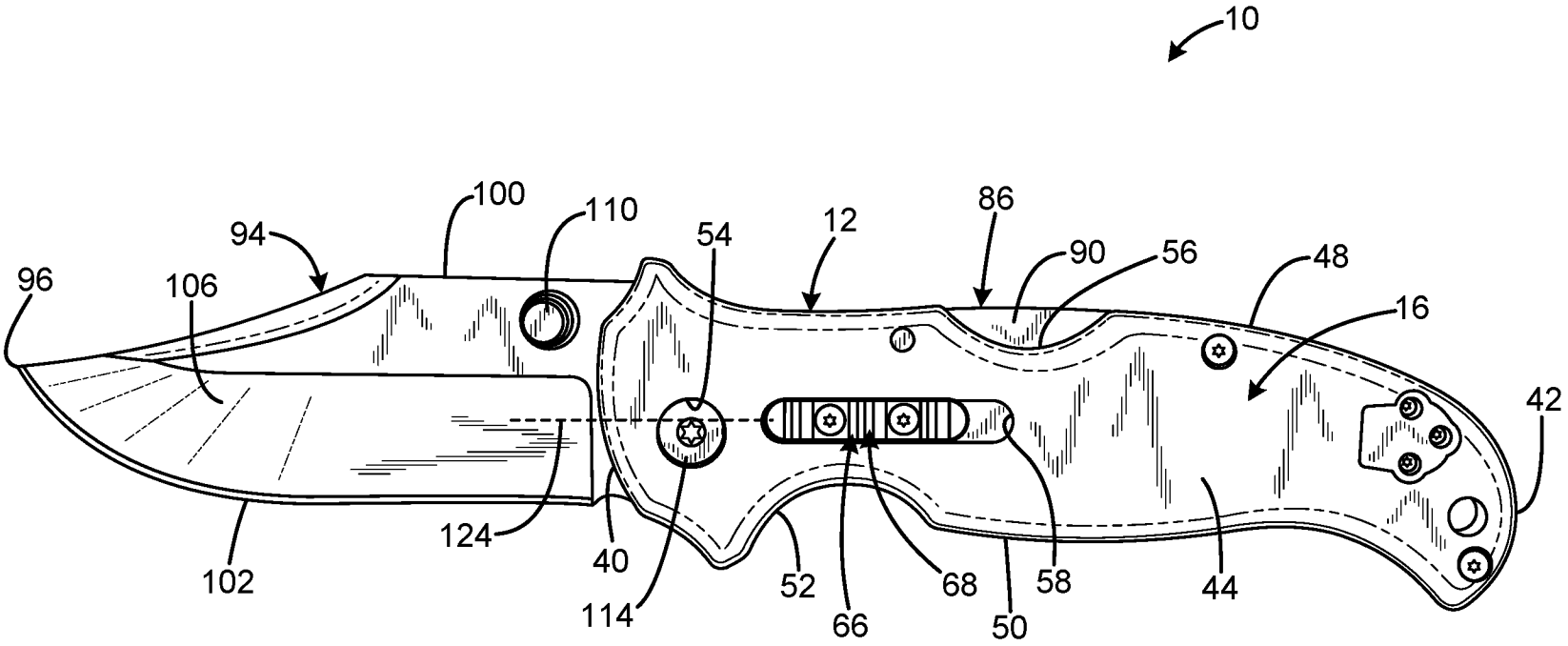
FIG. 1 is a left side view of the current embodiment of the folding knife constructed in accordance with the principles of the present invention.

An embodiment of the folding knife of the present invention is shown and generally designated by the reference numeral 10.

FIGS. 1-4 illustrate the improved folding knife 10 of the current invention. More particularly, the folding knife has an elongated handle 12 having a right frame 14 and a left frame 16. The right frame has a front 18, rear 20, exterior 22, interior 24, top 26, and bottom 28. The bottom front of the right frame defines a finger recess 30 that accommodates the user's index finger when the knife is held in the fully opened position. The front of the right frame defines a pivot aperture 32. The top middle of the right frame defines an exposure notch 34. The top rear of the right frame just behind the exposure notch defines a spring recess 36 that receives a spring 38.

The left frame 16 has a front 40, rear 42, exterior 44, interior 46, top 48, and bottom 50. The bottom front of the left frame defines a finger recess 52 that accommodates the user's index finger when the knife is held in the fully opened position. The front 40 of the left frame defines a pivot aperture 54. The top middle of the left frame defines an exposure notch 56. The exterior just behind the pivot aperture 54 defines a safety slider slot 58, and the interior just behind the pivot aperture 54 defines a corresponding, larger safety plate slot 60. A safety reinforcement plate 62 is received in the safety plate slot 60. The safety reinforcement plate 62 defines a slot 64. A safety element 66 has a safety slider 68 slidably received in the safety slider slot 58 and a connected safety plate 70 slidably received in the slot 64 in the safety reinforcement plate 62. The safety element 66 can be moved forward and rearward within the confines of the safety slider slot 58 and the slot 64 in the safety reinforcement plate 62. The safety slider 68 is an actuator surface external to the handle 12. The handle is an elongated body defining a major axis 124, and the safety element 66 is movable along the major axis. The safety slider slot 58 is a safety aperture in the handle that enables a portion of the safety element 66 (the safety slider 68) to extend through the safety aperture 58 and a portion of the safety element 66 (the safety plate 70) to be located inside the handle. The safety plate 70 has a front 72, rear 74, top 76, and bottom 78. The top 76 of the safety plate 70 includes an inwardly protruding safety button 80. The front 72 of the safety plate 70 and the front of the slot 64 in the safety reinforcement plate 62 are rounded to evenly distribute forces and prevent wear when the front 72 of the safety plate 70 is stopped by the front of the slot 64 in the safety reinforcement plate 62.

A rocker lock pin 82 is received within rocker lock pin aperture 84 in the right frame 14 and a corresponding rocker lock pin aperture (not visible) in the left frame 16. The rocker lock pin apertures are located near the tops 26, 48 of the right and left frames just forward of exposure notches 34, 56. A rocker lock/back lock element 86 is pivotally mounted on the rocker lock pin to connect the rocker lock to the handle 12. The rocker lock has a forward head portion/block portion 88, and top rear exposed portion 90, and a bottom 92. The top rear exposed portion of the rocker lock is exposed by the exposure notches so the user can depress the top rear exposed portion to raise the forward head portion of the rocker lock. The spring 38 biases the rocker lock to the locked position. The rocker lock is a planar body having opposed major faces and a peripheral profile. The rocker lock is pivotally connected to the handle at a lock pivot point defined by the rocker lock pin at an intermediate position on the rocker lock.

An elongated blade 94 is pivotally mounted on a blade pivot pin 114 received in the pivot apertures 32, 54 in the right and left frames 14, 16. The blade has a tip end/opposed free end 96, a tang/pivot end 98, a spine edge 100, a cutting-edge 102, a right face 104, and a left face 106. Thumb studs 108, 110 protrude outwardly from the right face and left face just below the spine edge to facilitate blade opening. The spine edge of the tang defines a notch 112 that is sized to closely receive the forward head portion 88 of the rocker lock 86 when the blade is in the open/unfolded position. When the forward head portion of the rocker lock is received in the notch in the spine edge of the tang, the blade is locked in the unfolded/open position and cannot be closed. The tang includes a rounded portion 116 so the forward head portion of the rocker lock does not interfere with pivoting of the blade about the blade pivot pin as the blade is folded and unfolded/closed and opened. The tang also includes a recess 118 that receives the forward head portion of the rocker lock when the blade is folded/closed (denoted by the dashed lines in FIG. 2), which causes the blade to provide some resistance to opening when the safety element is disengaged.

Figure 2:
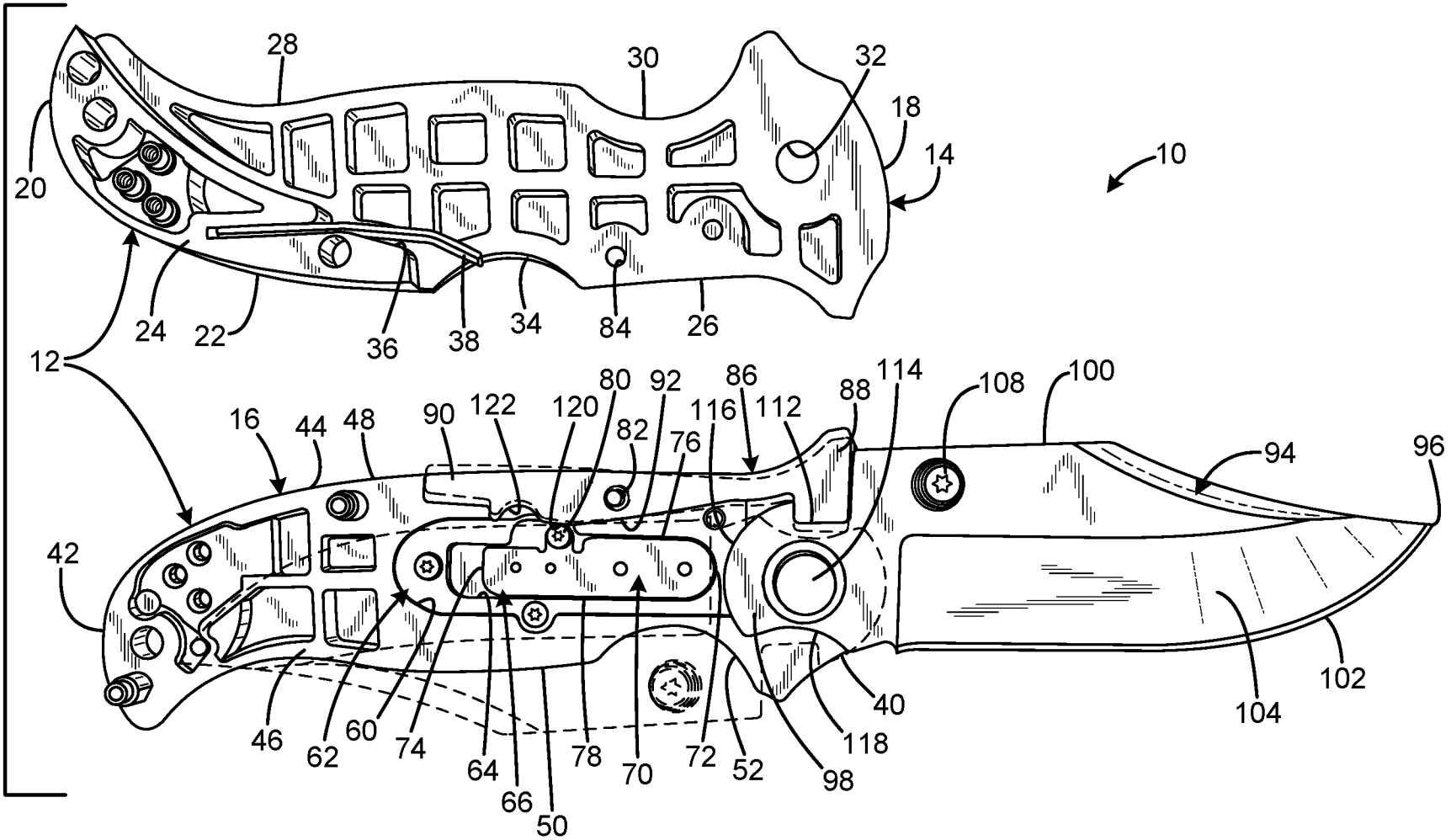
FIG. 2 is a right side view of the current embodiment of the left frame of the folding knife of FIG. 1 with the right frame removed with the blade unfolded, the rocker lock locked, and the safety engaged.
Figure 5:
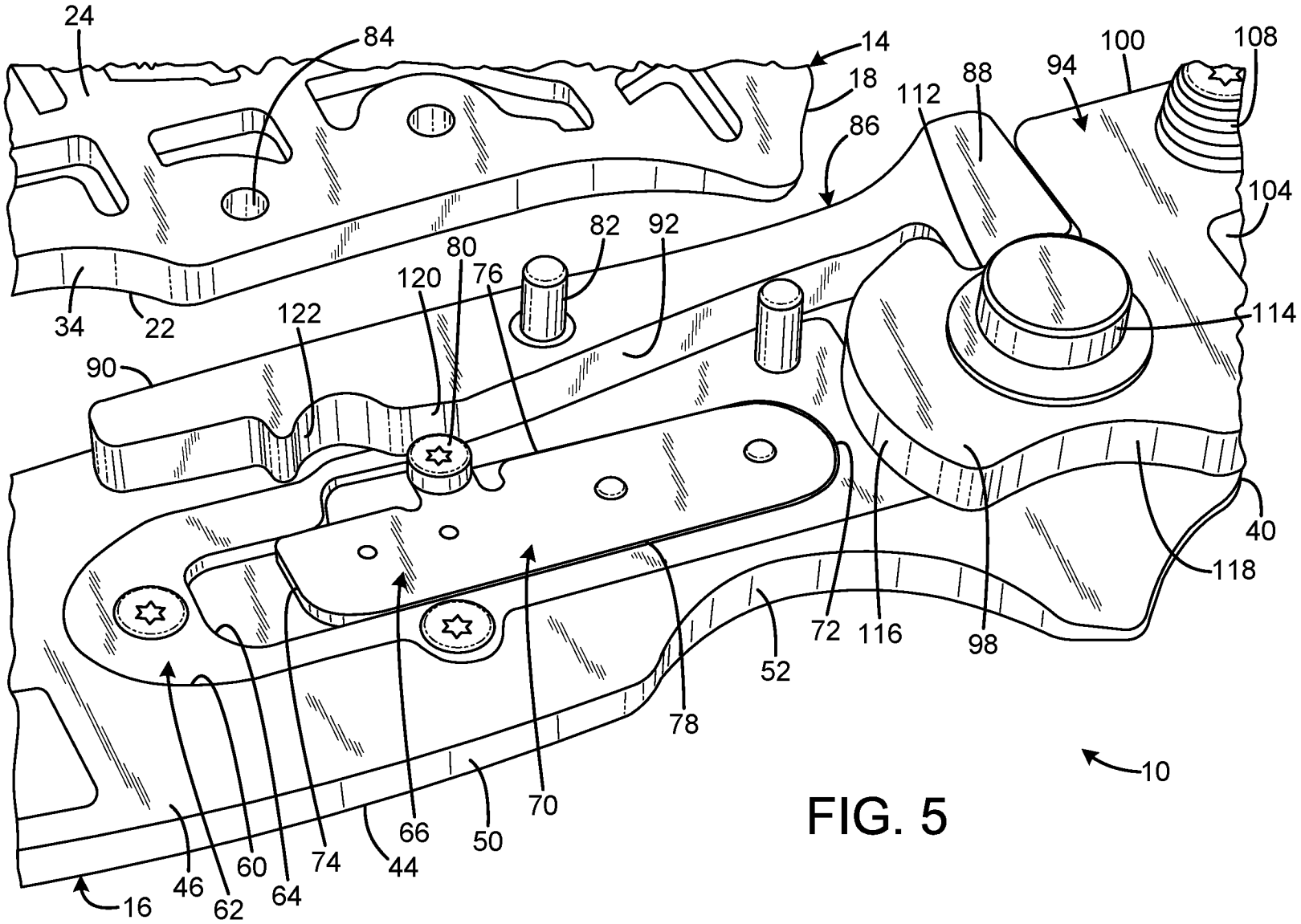
FIG. 5 is a rear perspective enlarged view of the current embodiment of the left frame of the folding knife of FIG. 1 with the right frame removed with the blade unfolded, the rocker lock locked, and the safety engaged.

FIGS. 1, 2, and 5 illustrate the improved folding knife 10 of the current invention with the blade 94 locked in the unfolded/open position by the rocker lock 86 with the safety element 66 engaged. The blade extends away from the handle 12 in the open position. More particularly, the spring 38 has urged the forward head portion 88 of the rocker lock 86 into engagement with the notch 112 in the tang 98 of the blade, which prevents the blade from being folded/closed. The safety element has been slid forward within the safety slider slot 58 and the slot 64 in the safety reinforcement plate 62 to the engaged position. In the engaged position, the safety button 80 is positioned beneath surface 120, which is a substantially flat region defined by the bottom 92 of the rocker lock. Thus, the safety element overlaps the peripheral profile of the rocker lock when in the engaged position. The surface 120 can be viewed as a safety engaging surface 120 configured to contact the protrusion (the safety button 80) when the safety element is in the engaged position and the rocker lock is in the locked position to prevent movement of the rocker lock to the unlocked position. With the safety button positioned beneath surface 120, the top rear exposed portion 90 of the rocker lock is obstructed from being depressed. As a result, the rocker lock cannot pivot to disengage the forward head portion from the notch and the tang of the blade. Thus, the engaged safety element makes the rocker lock enormously resistant to shock and impact, which prevents inadvertent folding/closure of the blade. The rocker lock and the blade occupy a common planar layer of the folding knife 10, and the safety element is outside the common planar layer except for a protrusion (the safety button) extending into the common planar layer.

Figure 3:
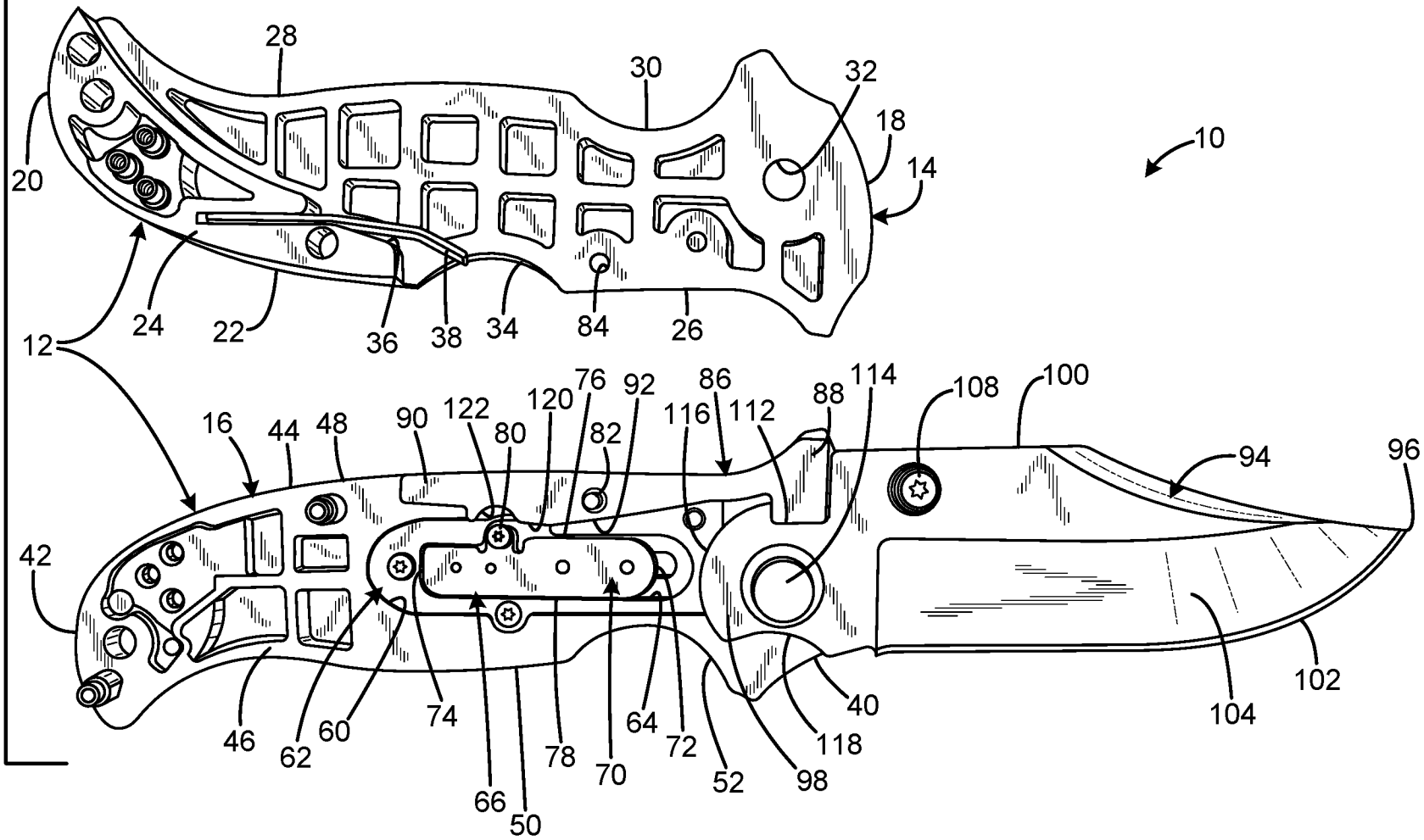
FIG. 3 is a right side view of the current embodiment of the left frame of the folding knife of FIG. 1 with the right frame removed with the blade unfolded, the rocker lock locked, and the safety disengaged.

FIG. 3 illustrates the improved folding knife 10 of the current invention with the blade 94 locked in the unfolded/open position by the rocker lock 86 with the safety element 66 disengaged. More particularly, the safety element has been slid rearward within the safety slider slot 58 and the slot 64 in the safety reinforcement plate 62 to the disengaged position. In the disengaged position, the safety button 80 is positioned beneath recess 122, which is a curved region defined by the bottom 92 of the rocker lock. Thus, the safety element is clear of the rocker lock's peripheral profile when in the disengaged position. With the safety button positioned beneath recess 122, the top rear exposed portion 90 of the rocker lock is free to be depressed once sufficient downward force is exerted to overcome the pressure exerted by spring 38. Thus, although the rocker lock continues to lock the blade in the unfolded/open position, the user can depress the top rear exposed portion of the rocker lock to enable the blade to fold. The recess 122 can be viewed as a protrusion receptacle 122 configured to receive the protrusion (the safety button 80) when the safety element is in the disengaged position and the rocker lock is in the unlocked condition. Thus, when the blade is in the open position, the safety element is configured when in the engaged position to contact the rocker lock to prevent the rocker lock from moving to the unlocked position, and when the safety element is in the disengaged position, movement of the rocker lock element to the unlocked position is enabled to enable movement of the blade to the closed position. The rocker lock is moved to the unlocked position by application of pressure to the top rear exposed portion of the rocker lock away from the blade with respect to the lock pivot point defined by the rocker lock pin 82, such that the forward head portion of the rocker lock moves away from the pivot portion/tang 98 of the blade when the rocker lock is moved to the unlocked position.

Figure 4:
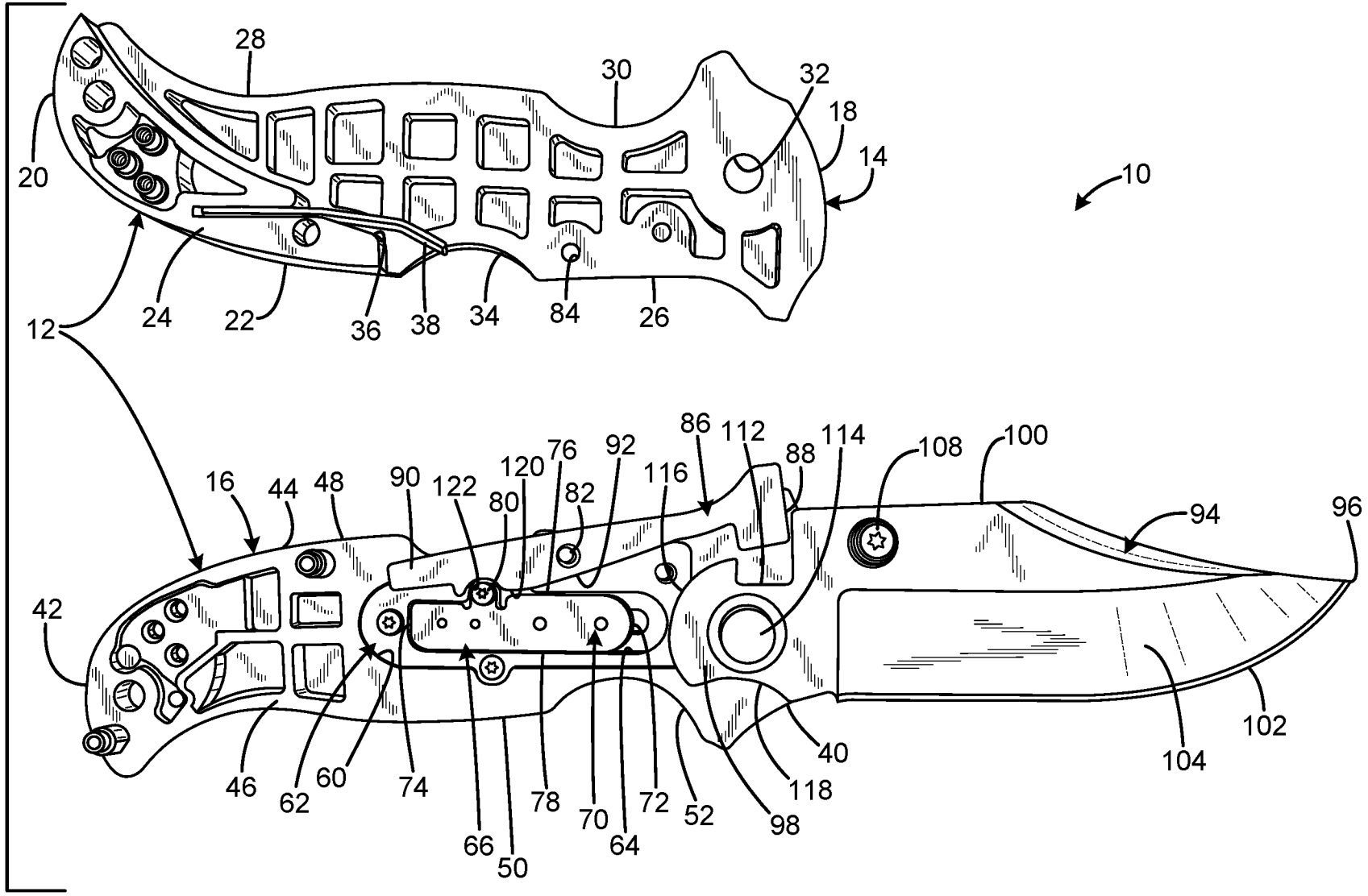
FIG. 4 is a right side view of the current embodiment of the left frame of the folding knife of FIG. 1 with the right frame removed with the blade unfolded, the rocker lock unlocked, and the safety disengaged.
Figure 6:
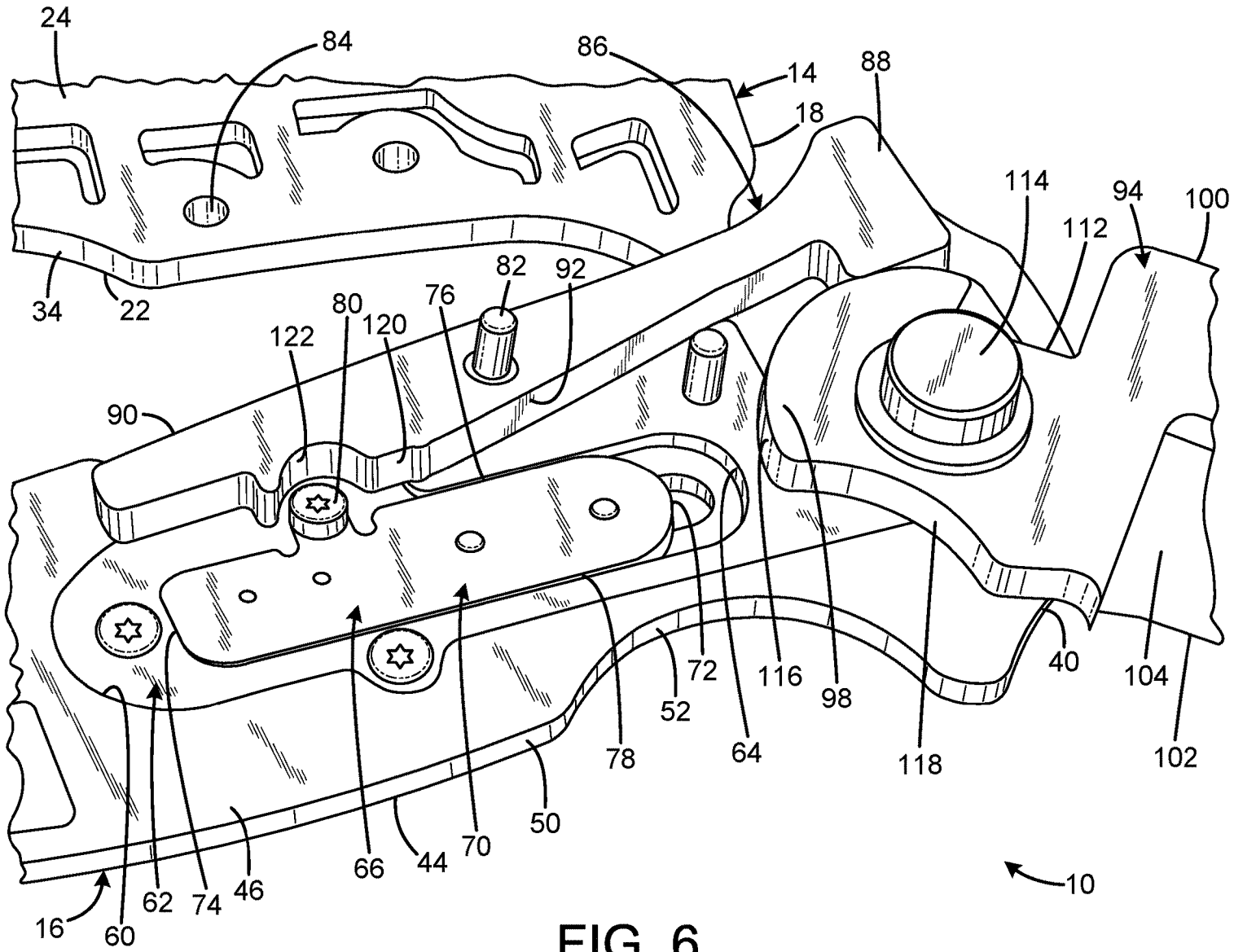
FIG. 6 is a rear perspective enlarged view of the current embodiment of the left frame of the folding knife of FIG. 1 with the right frame removed with the blade partially folded, the rocker lock unlocked, and the safety disengaged.

FIGS. 4 and 6 illustrate the improved folding knife 10 of the current invention with the blade 94 unlocked in the unfolded/open position (FIG. 4) and in a partially folded position (FIG. 6) with the safety element 66 disengaged. More particularly, in FIG. 4 sufficient downward force has been exerted upon the top rear exposed portion 90 of the rocker lock 86 to overcome the spring force exerted by spring 38 and pivot the forward head portion 88 of the rocker lock out of engagement with the notch 112 in the tang 98 of the blade. Once the rocker lock is in this position, the user can press downward on the spine edge 100 of the blade to pivot the blade clockwise about the blade pivot pin 114 into the position shown in FIG. 6 to begin folding/closing the blade. As is shown in FIG. 6, the forward head portion of the rocker lock rides on the rounded portion 116 of the tang to enable further pivoting of the blade until the blade reaches the folded/closed position with the forward head portion of the rocker lock engaging the recess 118 of the tang. Thus, the rocker lock is movable between a locked position in which the forward head portion/block portion operably contacts a portion of the pivot end of the blade (notch 112 in the tang of the blade) to prevent movement of the blade from the open position to the closed position, and an unlocked position in which movement of the blade from the open position to the closed position is enabled. While the forward head portion 88 of the rocker lock engages the recess 118 of the tang, the blade will not open unless sufficient force is applied to one of the thumb studs 108, 110 to overcome the force exerted by the spring 38 to disengage the forward head portion of the rocker lock from the recess 118. If the safety element 66 is slid forward to the engaged position while the forward head portion of the rocker lock engages the recess 118 of the tang, the safety button 80 is again positioned beneath surface 120. While the safety button 80 is positioned beneath surface 120, the rocker lock 86 cannot pivot to disengage the forward head portion 88 of the rocker lock from the recess 118 of the tang, thereby securing the blade in the folded/closed position even if enough force is applied to either of the thumb studs to overcome the force exerted by spring 38. In the folded/closed position, the blade is protectively received in a channel defined by the interiors 24, 46 of the right and left frames 14, 16 of the handle 12.

While a current embodiment of a folding knife has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A folding knife, comprising:

a blade having a pivot end and a free end;

the pivot end of the blade being pivotally connected to a handle, the handle including a right frame and a left frame, a forward portion adjacent to the blade, and a rear portion, one of the left frame and right frame defining a safety slot within the forward portion of the handle;

the blade being movable between a closed position in which the blade is protectively received by the handle and an open position in which the blade extends away from the handle;

a back lock element pivotally connected to the handle at a lock pivot point at an intermediate position on the back lock element, the back lock element having a block portion at a front portion thereof;

the back lock element movable between a locked position in which the block portion operably contacts a portion of the pivot end of the blade to prevent movement of the blade from the open position to the closed position, and an unlocked position in which movement of the blade from the open position to the closed position is permitted, the back lock element being biased towards the locked position by a spring, the back lock element being movable to the unlocked position by application of pressure on a rear portion of the back lock element;

a safety element movable between an engaged position and a disengaged position, the safety element including a safety plate and a safety slider secured to the safety plate, the safety slider protruding into the safety slot, and the safety plate including a safety button, the safety button protruding towards the rear portion of the back lock element;

when the blade is in the open position, the safety element being configured such that when the safety element is in the engaged position, the safety button contacts the rear portion of the back lock element and prevents the back lock element from moving to the unlocked position, and when the safety element is in the disengaged position, the safety element is configured such that it permits movement of the back lock element to the unlocked position to enable movement of the blade to the closed position.

2. The folding knife of claim 1 wherein the handle is an elongated body defining a major axis and wherein the safety element is movable along the major axis.

3. The folding knife of claim 1 wherein the back lock element and the blade occupy a common planar layer of the knife, and wherein the safety element is outside the common planar layer except for the safety button which protrudes into the common planar layer.

4. The folding knife of claim 3 wherein the back lock element defines a protrusion receptacle configured to receive the safety button when the safety element is in the disengaged position and the back lock element is in the unlocked position.

5. The folding knife of claim 4 wherein the rear portion of the back lock element includes a safety engaging surface configured to contact the safety button when the safety element is in the engaged position and the back lock element Is in the locked position to prevent the movement of the back lock element to the unlocked position.

6. The folding knife of claim 5, wherein the spring contacts the back lock element rearward of the protrusion receptacle and the safety engaging surface.

7. The folding knife of claim 3 wherein the rear portion of the back lock element includes a safety engaging surface configured to contact the safety button when the safety element is in the engaged position and the back lock element is in the locked position to prevent the movement of the back lock element to the unlocked position.

8. The folding knife of claim 3, wherein the one of the right frame and left frame which defines the safety slot also defines a safety plate slot, the safety plate moving within the safety plate slot between the engaged position of the safety element and the disengaged position of the safety element.

9. The folding knife of claim 1, wherein the back lock element defines a safety button receiving recess within its rear portion, the safety button receiving recess being dimensioned and configured to receive the safety button when the safety element is in the disengaged position and the back lock element is in the unlocked position.

10. The folding knife of claim 1, wherein the one of the right frame and left frame which defines the safety slot also defines a safety plate slot, the safety plate moving within the safety plate slot between the engaged position of the safety element and the disengaged position of the safety element.

* * * * *